United States Patent [19]

Braun

[11] Patent Number: 4,577,781

[45] Date of Patent: Mar. 25, 1986

[54] APPARATUS FOR CONTROLLING THE REGULATOR OF A DEVICE FOR SPREADING SALT OR THE LIKE ON ROADS

[76] Inventor: Otto P. Braun, Ludwigsburger Strasse 80, D-7141, Freiberg/Neckar, Fed. Rep. of Germany

[21] Appl. No.: 549,775

[22] Filed: Nov. 8, 1983

[30] Foreign Application Priority Data

Nov. 9, 1982 [DE] Fed. Rep. of Germany ..... 3241285

[51] Int. Cl.[4] ..... E01G 1/00

[52] U.S. Cl. ..... 222/54; 404/101

[58] Field of Search ..... 404/101; 222/54, 410, 222/608; 37/197, 227; 106/13

[56] References Cited

FOREIGN PATENT DOCUMENTS 2648906 5/1978 Fed. Rep. of Germany .
2914158 4/1979 Fed. Rep. of Germany .

*Primary Examiner*—Stanley H. Tollberg
*Attorney, Agent, or Firm*—Steele, Gould & Fried

[57] ABSTRACT

An apparatus for controlling the regulator of a device for spreading salt and the like onto road surfaces, the apparatus comprising: a sensor for measuring the temperature of liquid on the road surface; a collector for liquid removed from the road surface, adapted for operation on a moving vehicle; a device operatively associated with the collector for measuring the concentration of salt in the collected liquid; and, a device operatively associated with the collector for measuring the quantity of liquid present per surface unit area of the road, based upon the quantity of collected liquid and a measured factor related to movement of the vehicle along the road, whereby sufficient information is available from the apparatus for regulation of a device for spreading salt and the like to achieve a salt concentration on the road surface just sufficient to avoid freezing at any predetermined tempertaure and for any predicted quantity of precipitation. The factor related to movement of the vehicle includes vehicle speed or distance travelled. The collector may comprise a suction device carried by the vehicle. The apparatus may comprise a common measuring chamber for housing the salt concentration and liquid quantity measuring devices. The liquid collector and liquid quantity measuring devices may be operated intermittently. The apparatus may be connected directly to a spreader device for automatically controlling the spreader, or may be connected to a display enabling manual control of the spreader.

10 Claims, 2 Drawing Figures

APPARATUS FOR CONTROLLING THE REGULATOR OF A DEVICE FOR SPREADING SALT OR THE LIKE ON ROADS

BACKGROUND OF THE INVENTION

1. Field of the Invention

The present invention relates to an apparatus for regulating a mechanism for spreading or strewing salt or the like on roads, as a function of a salt content and temperature measurement of the liquid on the road, with a liquid receiver arranged on a vehicle and a salt content measuring device connected thereto, as well as a temperature measuring device.

2. Prior Art

Such an apparatus is known from German Pat. No. 2,648,906. This patent relates to an apparatus for determining the risk of ice forming on roads, which operates in conjunction with a receiver in the form of a wheel, which runs on the road and which takes up liquid, which is supplied to a salt content and temperature measuring device. As a function of the salt content and temperature of the road moisture, it is established what safety tolerance there still is between the existing temperature and the freezing point of the liquid based on the salt content.

German published application (DE-OS) No. 2,914,158 describes another such apparatus, which in this case operates with a contact-less temperature sensor and which can directly control a salt spreader, i.e. on dropping below the freezing point or a predetermined safety tolerance between the freezing point and the existing temperature, the spreader is automatically switched on.

European published application (EP-OS) No. 0,006,272 also discloses such an apparatus, in the form of a box or frame, which is placed on a road. A solvent is then introduced into this frame and subsequently the concentration is measured electrically. Such an apparatus cannot be used in normal highway monitoring operations and certainly not by a moving vehicle.

SUMMARY OF THE INVENTION

The object of the present invention is to provide an apparatus for regulating a mechanism for spreading salt or the like on roads, which makes it possible to bring the salt concentration of the liquid on the road to a predetermined value, while avoiding oversalting or undersalting of the road surface.

According to the invention, this problem object is achieved by a quantity or volume meter for the quantity of liquid present on the road per unit area and which operates in conjunction with the receiver.

In the case of prior art apparatuses, it was only possible to establish whether salting was or was not necessary, although unsupported conclusions are often drawn regarding the necessary setting of the salt spreader on the basis of the tolerance between the freezing point of the salt/water solution and the existing or expected temperature. The present invention, quite to the contrary makes it possible to so regulate or control the spreader that, after spreading, is the salt concentration is not merely increased, but is brought to a predetermined salt concentration, i.e. exhibiting predetermined freezing point which, e.g. as a function of the expected night temperature, is sufficient to prevent the road freezing over. In the case of a fully automatic control, the spreader can then vary the quantity of salt to be discharged, as a function of the liquid quantity on the road, so as to prevent harmful and costly oversalting in drier areas.

However, the invention can also be advantageously used for the indirect control of the spreader, in that e.g. a value is displayed on a display enabling the highway authority personnel to correctly adjust setting of the spreader. The apparatus can also be used for all other means for discharging mixed spreading material or other types of freezing point-reducing agents, e.g. saline solution spraying means.

The liquid receiver or collector is preferably a suction device arranged on the vehicle. Such a suction device, which preferably operates with a liquid separator downstream thereof, can operate satisfactorily when moving and provides a good reproducible value for the liquid quantity. However, it is also possible to use other receivers, e.g. specially profiled wheels, whereof the liquid quantity sprayed by them when running on the wet road surface can be related to the liquid quantity on the road, as a function of the speed. It would also be possible to use receivers with an intermediate store, e.g. a wheel with a foam covering, which sucks full to a greater or lesser extent when running on the road surface, as a function of the liquid quantity present thereon and then presses this liquid quantity out in order to determine the same. Another possibility would be a simple spatula or trowel-like receiver, although this would not operate very accurately on rough road surfaces. However, it is in all cases advantageous that it is possible with the receiver to simultaneously take up the liquid for quantity measurement and also for salt content measurement.

The receiver/collector and/or quantity meter can function discontinuously. The most varied constructional embodiments are possible. However, particular preference is given to the salt content and quantity meter having a common measuring chamber. For example, this can be a measuring chamber to be emptied by means of a slide member, on which the time necessary for filling or the distance covered in this time is measured, leading to a measured value for the liquid quantity. The concentration measurement for the salt content can then be carried out electrically in the filled measuring chamber. For this purpose, it is possible to use the devices described in German Pat. No. 2,648,906 and DE-OS No. 2,914,158, to which express reference is made.

The quantity meters can also be flowmeters with mechanical or electrical, e.g. electromagnetic flow sensors, or also weighing or other volumetric devices.

It is pointed out that in the case of a highway spreading means moving with the measuring vehicle or towed by the latter, the control of the spreading means can take place as a function of the liquid quantity taken up, without taking account of the travel speed, even though the discharge of the spreading agent quantity takes place as a function of the time unit. In this case, the distance or speed factor in the measurement and the regulated quantity cancel one another out, because in the case of higher speed the amount of liquid taken up per unit of time is greater, but so is the salt requirement.

It is not normally considered necessary to keep the receiver in operation throughout the entire journey of the highway authority vehicle. For example, the measurement can take place by placing a suction apparatus on the road with a particular timing interval, or following an individual control by the driver. In order to take account of the influence of the air stream of flow and to prevent ice forming in the receiver, the latter can be heated, advantageously in such a way that it is directly controlled by the temperature of the liquid taken up. The result of the measurement can also be corrected, as a function of the temperature of the salt/water solution, as described in DE-OS No. 2,914,158.

The use of a powerful suction apparatus also makes it possible to obtain a result in the case of a dry highway, in that then dry salt is sucked up and optionally this can then be mixed with a corresponding metered water quantity. Thus, this dry salt quantity can also be determined and in the case of e.g. contact-free temperature measurement of the road surface, it can be established whether the necessary security against ice formation still exists in the case of a specific, expected quantity of precipitation.

It is also possible to carry out a trial run with a highway authority vehicle and as a function thereof, to supply data for the setting of the spreading agent quantity to spreader vehicles running independently of the measuring vehicle.

BRIEF DESCRIPTION OF THE DRAWINGS

The invention is described in greater detail hereinafter relative to non-limiting embodiments shown in the drawings, wherein.

DETAILED DESCRIPTION OF THE PREFERRED EMBODIMENTS

Figure 1:
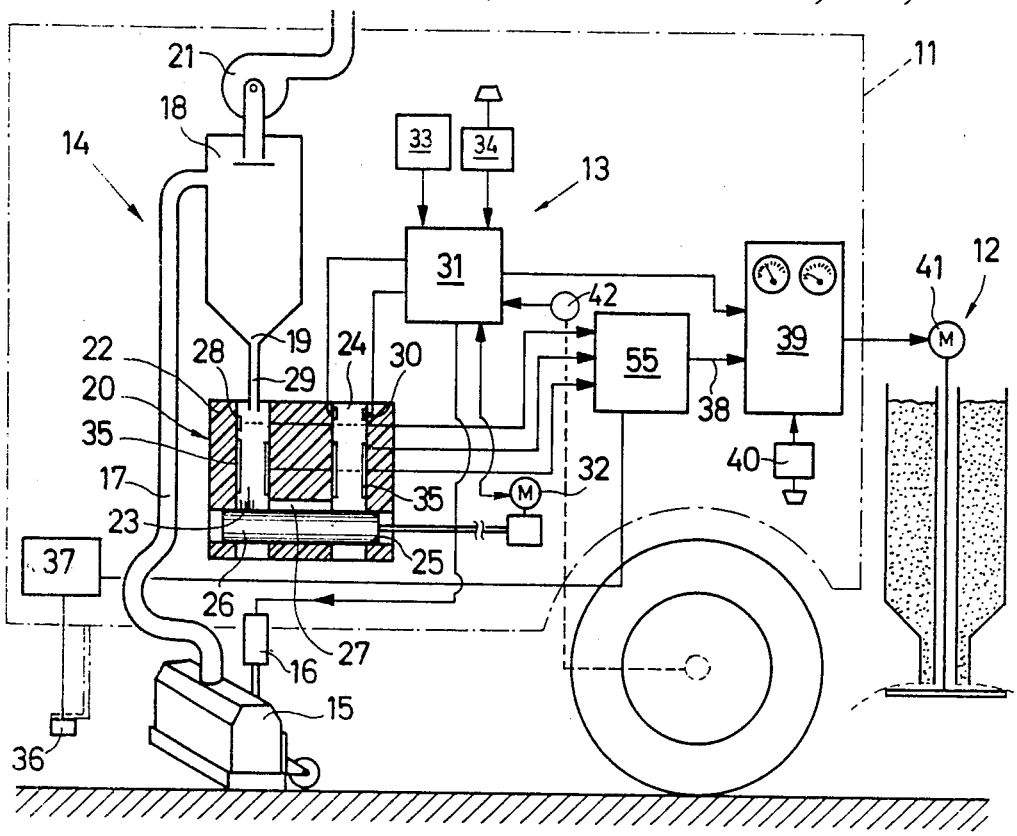
FIG. 1 is a diagrammatic view and circuit diagram of an apparatus for regulating a road spreader.

FIG. 1 shows a road spreader 12 in the form of a salt spreader and a regulating apparatus 13 for the spreader on a vehicle 11.

The apparatus in the represented embodiment has a liquid receiver or collector 14 in the form of a suction device, as is known from commercial suction apparatus or highway cleaning vehicles. It has a suction head 15 and a raising and lowering means 16.

A separating container 18 is connected by means of a suction hose 17 and can function e.g. in the manner of a cyclone separator and from which the separated liquid is fed by means of an outlet 19 to a measuring chamber 20, or optionally, via a dirt separator or strainer (not shown). The suction fan 21 of the suction apparatus is connected to separating container 18.

The measuring chamber 20 comprises an insulating unit 22, in which are provided two vertical, parallel, juxtaposed measuring chamber bores 23, 24 at a certain distance from one another and which are formed in the lower area by a bore 25. In the represented states, bore 25 is closed by a cylindrical slide 26, so that the two measuring chamber bores 23, 24 are closed at the bottom. Following onto bore 25, a slot 27 is provided in its upper area and contains a wall separating the two bores 23, 24 and consequently interconnects the latter two bores 23, 24. On the top of slide 26 is provided a cleaning brush, which passes through slot 27 on retraction of the slide and thereby cleans the slot.

In the wall area of the two measuring chamber bores are provided relatively large-surface, tubular electrodes 35 which, together with the relatively long path through the electrolytes defined by the slot 27, permit a very good salt content measurement. Further details on the construction of the measuring chamber are provided in DE-OS No. 2,914,158, to which express reference is made.

The measuring chamber also contains a temperature sensor 28, which supplies a temperature value for compensating the temperature dependence of the salt concentration measurement.

The liquid intake 29 is directed into measuring chamber bore 23. Electrodes 30 are provided on the upper part of measuring chamber bore 24, where there is an overflow for excess liquid, and they supply a pulse to the control device 31 belonging to the quantity meter, when the liquid has reached the outlet. Slide 26 can be moved in and out by a motor 32, which can be operated from control device 31.

The quantity measuring cycle either starts in a time-controlled manner using timer 33, or manually by means of a switch 34. The suction head 15 is placed with means 16 on the road surface and either simultaneously, or with a certain time lag, slide 26 is closed by means of motor 32. The sucked-in liquid quantity is dependent on the width of the suction head 15, the amount of liquid on the road surface and the distance covered per unit of time. Thus, the liquid separated from the separating container fills the measuring chamber 20 more or less rapidly. When the measuring chamber filling sensor in the form of electrode 30 responds, the time which has elapsed up to then is determined in control device 31. This time has a more or less linearly inversed dependence on the quantity of liquid per unit are on the road during this unit of time. By feeding a measured value derived from a speed indicator, e.g. a tachometer, into the control device 31, it is possible to determine the absolute quantity in grams per square meter ($g/m^2$) or liters per square meter ($l/m^2$) of the road surface. Instead of a time measurement for the filling of the measuring chamber, it would also be possible to directly carry out a distance measurement, which directly supplies the value.

The salt concentration measurement is then carried out in known manner when the measuring chamber is full and this takes place by means of the two large-surface, tubular electrodes 35 and the measuring channel in the form of slot 27. The measured salt concentration value obtained is compared in the regulating device 55 with the signal of a contact-free temperature measuring device 37 with an infrared sensor 36, which is directed onto the road and supplies to output line 38 a temperature difference value between the freezing point of the salt/water solution and the existing road surface temperature. Line 38 is connected to a control and indicating device 39, which also receives signals from the quantity control device 31.

The indicating and control device 39 has information on the freezing point difference temperature and the liquid quantity per time or surface unit. On the basis of these values, a spreader can be manually controlled.

However, in the represented embodiment, the spreader 12, which has a regulatable driving or metering motor 41, is directly connected to the indicating and control device 39. By means of a manually operable setting device 40, it is now possible to set the operating procedure. Advantageously, the indicating and control device is programmed in such a way that spreading will only start below a given threshold difference temperature between the freezing point and the ambient temperature. However, this threshold value can differ in a control program, in order to take account of an expected precipitation period and as a function of the quantity of salt on the road (determined by liquid quantity measurement and salt concentration), so that e,g. a precautionary after-salting can take place at points with only a little liquid with a low salt concentration to a value above a per se safe threshold value, in order to obtain absolute security against freezing of precipitation expected overnight. On dropping below the threshold value, the spreader is put into operation and, as a function of all the measured values, the spread quantity is so adjusted that on all sections of the highway there is a salt concentration which, with the existing or expected ambient temperature, is just sufficient to prevent ice formation. Here again, account can naturally be taken of expected precipitation by manual action or a corresponding programming of the control device.

It is pointed out that after the level sensor 30 has responded, the suction head 15 can again be raised from the road surface and after a salt content measurement has been performed, the slide 26 can be opened by means of motor 32 also in order to again empty and therefore also clean the measuring chamber.

By means of timer 32 or the manual switch 34, the measuring process is automatically or manually repeated every so often.

In the case of a time-dependent metering of the quantity of spreading agent in the case of spreader 12, it is also possible for the liquid quantity measurement to take place in a purely time-dependent manner. However, if an indication or information is required, which is to be used for regulating the quantity of spreading agent for other spreader vehicles, or if a speed-dependent metering spreader is used, this measured value can be supplied by a tachometer 42 driven by the vehicle wheels supplying a corresponding test signal to the control device 31, which is dependent on the speed or distance. The represented measuring device measures with a constant measuring quantity and variable time or distance. However, it is also possible to operate with constant time or distance, in that e.g. the suction head 15 is placed on the highway for a certain time or distance and the liquid quantity taken up thereby is measured. In each case and as a function of the different receivers, a correction device (not shown) is provided, which takes account of the effect of different travelling speeds and/or different liquid quantities on the result of the measurement with empirically determined correction quantities. The result of the measurement can be recorded with a recorder for documentation purposes and for ease of examination.

Figure 2:
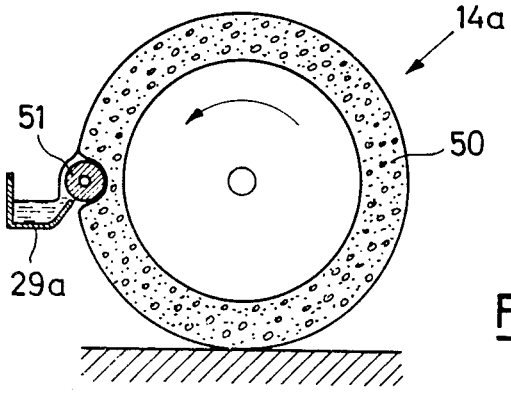
FIG. 2 is a diagrammatic view of a receiver or collection wheel.

FIG. 2 shows a liquid receiver or collector 14*a*, which comprises a measuring wheel, which can be fitted to a vehicle in such a way that it can be raised and lowered and has over a clearly defined width a foam covering 50, which is able to absorb road moisture, when the receiver is lowered onto the road surface. The liquid absorbed therein is pressed out by means of one or more squeezing rolls 51 and is supplied to the quantity meter by means of a liquid feed 29*a*. Thus, the receiver 14*a* would replace the suction means 14. Otherwise, the apparatus can operate in the manner described relative to FIG. 1.

If the receiver/collector is placed on the spreader vehicle and sufficiently far in front of the spreading means, within the time difference produced by the speed of travel, it is possible for the control system to immediately operate and set the existing values on the spreader.

What is claimed is:

1. An apparatus for controlling the regulator of a device for spreading salt and the like onto road surfaces, the apparatus comprising:

means for measuring the temperature of liquid on the road surface;

means for collecting liquid from the road surface, adapted for operation on a moving vehicle;

means operatively associated with the collecting means for measuring the concentration of salt in the collected liquid; and, means operatively associated with the collecting means for measuring the quantity of liquid present per surface unit area of the road, based upon the quantity of collected liquid, a width of said collecting means, and a measured factor related to movement of the vehicle along the road, whereby sufficient information is available from the apparatus for regulation of a device for spreading salt and the like to achieve a salt concentration on the road surface just sufficient to avoid freezing at any predetermined temperature and for any predicted quantity of precipitation.

2. An apparatus according to claim 1, wherein the collecting means comprises a a suction device carried by the vehicle.

3. An apparatus according to claims 1 or 2, wherein the means for collecting liquid and the liquid quantity measuring means operate intermittently.

4. An apparatus according to claim 1, wherein the apparatus is connected to the spreading device for automatically controlling the spreading device.

5. An apparatus according to claim 1, further comprising a common measuring chamber for housing the salt concentration measuring means and the liquid quantity measuring means.

6. An apparatus according to claim 1, further comprising means for measuring the factor related to movement of the vehicle.

7. An apparatus according to claim 1, wherein the temperature measuring means operates remotely from the road surface.

8. An apparatus according to claim 1, wherein the apparatus is connected to display means enabling manual control of the spreading device.

9. An apparatus according to claim 6, wherein the movement factor measuring means measures vehicle speed.

10. An apparatus according to claim 6 or 9, wherein the movement factor measuring means measures vehicle distance travelled.

* * * * *